United States Patent [19]
Marshke
[11] 4,425,870
[45] Jan. 17, 1984

[54] PAINT SPRAY BOOTH

[76] Inventor: Hugh E. Marshke, 7240 W. Cedarcroft, W. Bloomfield, Mich. 48033

[21] Appl. No.: 362,980

[22] Filed: Mar. 29, 1982

[51] Int. Cl.[3] ..... B05B 15/00

[52] U.S. Cl. ..... 118/326; 118/DIG. 7; 98/115 SB; 261/112; 55/240; 55/241; 427/424

[58] Field of Search ..... 427/421, 424; 118/326, 118/DIG. 7; 98/115 SB; 261/112; 55/240, 241

[56] References Cited

U.S. PATENT DOCUMENTS

| | | | |
|---|---|---|---|
| 1,402,147 | 1/1922 | Day | 261/112 |
| 2,077,427 | 4/1937 | Lissman | 261/112 |
| 3,466,019 | 9/1969 | Priestley | 261/112 |
| 3,934,495 | 1/1976 | Bloomer | 118/326 X |
| 4,241,646 | 12/1980 | Tsuruta et al. | 118/326 X |
| 4,285,270 | 8/1981 | Donahue | 98/115 SB |
| 4,299,602 | 11/1981 | Cordier et al. | 118/326 X |
| 4,350,506 | 9/1982 | Otto | 98/115 SB |

*Primary Examiner*—Shrive P. Beck

*Attorney, Agent, or Firm*—Gifford, VanOphem, Sheridan & Sprinkle

[57] ABSTRACT

A novel paint spray booth is disclosed for spray painting articles, such as motor vehicles. The paint spray booth comprises a housing having a substantially horizontal floor spaced upwardly from its bottom thus forming an upper housing chamber and a lower housing chamber. The articles to be painted are conveyed through the upper housing chamber and are spray painted in the normal fashion. A plurality of air scrubber units are open to the floor and fluidly connect the upper and lower housing chambers. Water is supplied to the top of the floor and, simultaneously, air is inducted from the upper housing chamber and to the lower housing chamber through these ducts. Baffles are mounted within the air scrubber units for intermixing the water and air together so that paint particles entrained within the air become entrapped within the water. The paint laden water entering the lower chamber is collected and conveyed to a conventional sludge and filtration system while the purified air is exhausted to the atmosphere.

6 Claims, 4 Drawing Figures 3
3
30
32
34
36
38
40
42
44
46
48
80
82
84
86
14
16
18
20
22
24
26
28
52
54
56
58
60
62
64
66
100

PAINT SPRAY BOOTH

BACKGROUND OF THE INVENTION

I. Field of the Invention

The present invention relates to a paint spray booth particularly suited for spray painting articles, such as motor vehicles.

II. Description of the Prior Art

The previously known paint spray booths of the type used to paint articles, such as motor vehicles, typically comprise an elongated housing having side walls and a horizontal floor which divides the housing into an upper chamber and a lower chamber. The articles are conveyed through the upper chamber of the paint spray booth by a conveyor system so that the articles are spaced from each other. The articles are spray painted as they are conveyed through the housing upper chamber.

These previously known paint spray booths further include a plurality of longitudinally spaced air scrubber units which are positioned at longitudinally spaced intervals along the floor. Typically these air scrubber units, which fluidly connect the upper and lower housing chambers together, are aligned with the bottom of the articles as they are conveyed through the housing upper chamber.

In operation, exhaust fans induct air laden with paint particles from the upper chamber, through the air scrubber unit and into the lower housing chamber. Simultaneously, water is introduced to the air scrubber unit so that the air and water become intermixed.

In doing so, the paint spray particles become entrapped within the water thus polluting the water but purifying the air. The purified air is then exhausted to the atmosphere while the polluted water is collected and conveyed to a sludge and/or water filtration system.

These previously known paint spray booths, however, suffer from a number of disadvantages. One disadvantage of these previously known devices is that the inlets for the air scrubber units are positioned directly underneath the vehicles as they are spray painted. Consequently, the paint particles entrained in the air are inducted underneath the vehicle and thus contact and accumulate on the conveyor system which transports the vehicles through the paint spray booth. Such accumulation of paint on the conveyor requires periodic maintenance and cleaning of the conveyor system.

A still further disadvantage of many of these previously known paint spray booths is that the floor through which the air scrubber units are open is vertically spaced upwardly from the bottom of the paint spray booth by relatively large distance, typically eight feet or more. Such wide vertical spacing of the floor from the bottom of the paint spray booth is necessary to enable the air scrubber to completely intermix the paint spray particles with the water in order to adequately purify the air prior to its exhaust to the atmosphere. This high vertical height of the floor greatly increases the overall cost of the paint spray booth as well as the installation cost for the paint spray booth.

A still further disadvantage of many of these previously known paint spray booths is that the operating efficiency of the air scrubber is preset and nonadjustable once the air scrubber unit is constructed. Consequently, once constructed, the air scrubber unit cannot be easily modified to change its operating efficiency as required for future applications.

SUMMARY OF THE PRESENT INVENTION

The present invention provides a paint spray booth which overcomes all of the above mentioned disadvantages of the previously known paint spray booths.

In brief, the paint spray booth according to the present invention comprises a housing having a horizontal floor which divides the housing into an upper chamber and a lower chamber. The articles, such as motor vehicles, to be painted are conveyed through the upper chamber by a conventional conveyor system and these articles are spray painted in the conventional fashion.

A plurality of longitudinally spaced air scrubber units are open to the floor along the conveyor system and these air scrubber units establish fluid communication between the housing upper and lower chambers. These air scrubbers are preferably open along both sides of the vehicles to be painted so that, as air is inducted from the upper housing chamber and through the air scrubber units, the paint laden air does not significantly contact or accumulate on the conveyor system for the motor vehicles.

Simultaneously as the air is inducted through the air scrubber units, the upper surface of the floor is flooded with water and this water enters into the air scrubber units. Each air scrubber unit includes at least one and preferably several baffles to create turbulence in the air and water flow through the air scrubber unit and thus ensure complete mixing of the air and water in the desired fashion. Preferably, these baffles are removably positioned within the air scrubber unit so that the operating characteristics and efficiency of the air scrubber unit can be easily modified as required.

In operation, as the air and water is intermixed within the air scrubber units, the paint particles entrained within the air become entrapped within the water and this air-water mixture is exhausted into the lower housing chamber. The water, now polluted with paint particles, is collected in the lower housing chamber and conveyed to a suitable sludge or filtration system and the now purified air is exhausted out to the atmosphere.

In the preferred form of the invention, the air scrubber units intersect the housing floor at approximately a 60° angle. This in turn permits the floor to be positioned upwardly from the bottom of the housing by relatively small distance for example, less than $4\frac{1}{2}$ feet, even though the effective length of the air scrubber unit is much longer and sufficient to adequately purify the air passing through the air scrubber unit.

BRIEF DESCRIPTION OF THE DRAWING

A better understanding of the present invention will be had upon reference to the following detailed description when read in conjunction with the accompanying drawing, wherein the like reference characters refer to like parts throughout the several views, and in which.

DETAILED DESCRIPTION OF A PREFERRED EMBODIMENT OF THE PRESENT INVENTION

Figures 2, 3, 4:
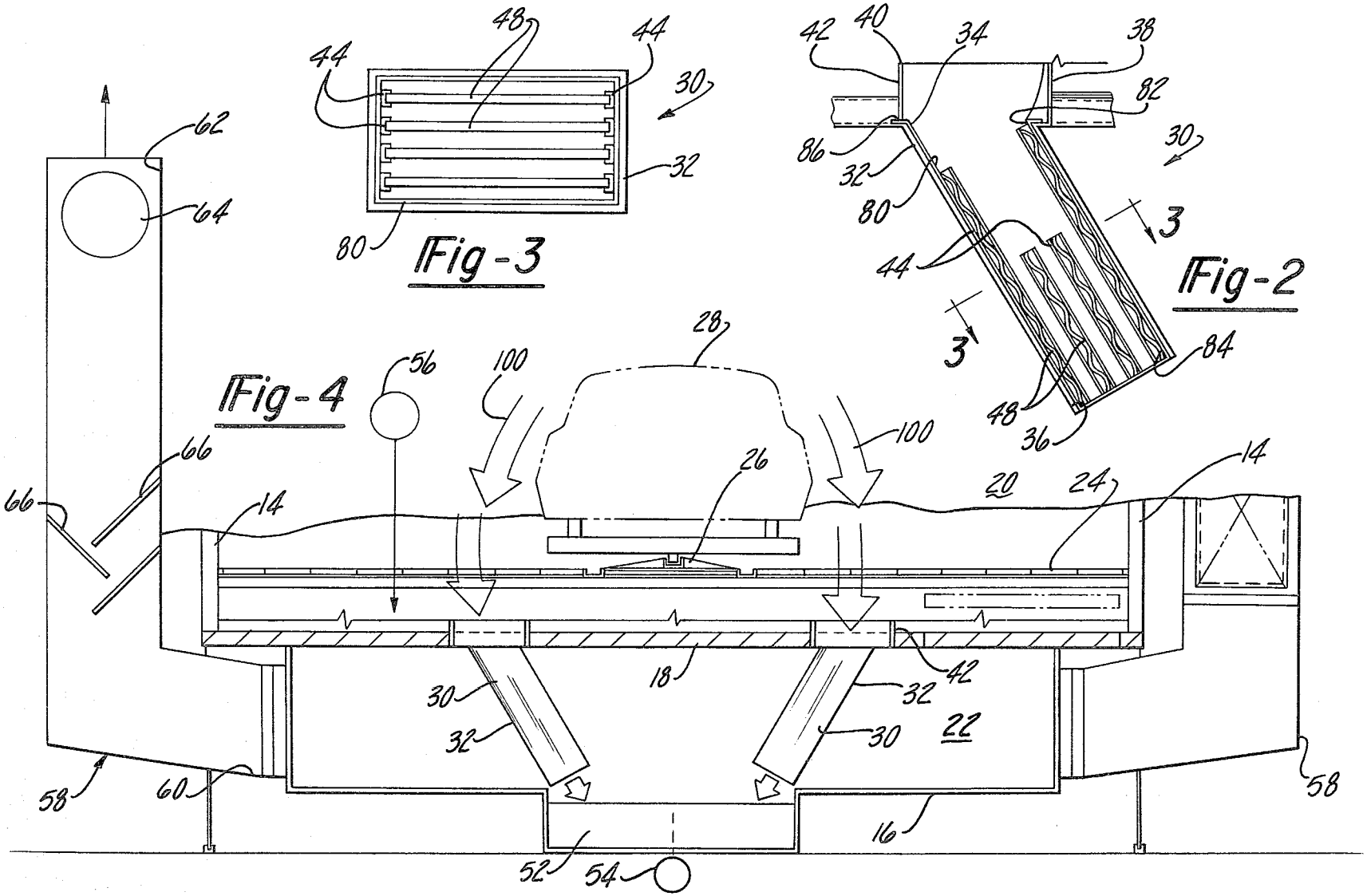
FIG. 2 is a longitudinal sectional view of a preferred form of the air scrubber section.
FIG. 3 is a cross sectional view taken substantially along line 3—3 in FIG. 2.
FIG. 4 is a diagrammatic end view of the preferred embodiment of the invention.

With reference first to FIGS. 2 and 4, a preferred embodiment of the paint spray booth according to the present invention is thereshown and comprises an elongated housing 10 having a top 12, side walls 14 and a bottom 16. A horizontal floor 18 is secured across the housing 10 at a position spaced upwardly from its bottom 16 thus forming an upper housing chamber 20 and a lower housing chamber 22. The housing floor 18 will be subsequently described in greater detail.

A horizontal grate 24 is also secured horizontally across the housing at a position spaced upwardly from the floor 18. A conveyor system 26 in turn is mounted to the grate 24 so that the conveyor system 26 extends longitudinally through the housing 10. The conveyor system 26 is conventional in construction and is used to transport the articles which are to be painted, such as motor vehicles 28 (FIG. 4), longitudinally through the housing upper chamber 20. It will be understood that the motor vehicle 28 shown in the drawing is by way of example only and that the paint spray booth of the present invention can be used to paint other types or articles.

Figure 1:
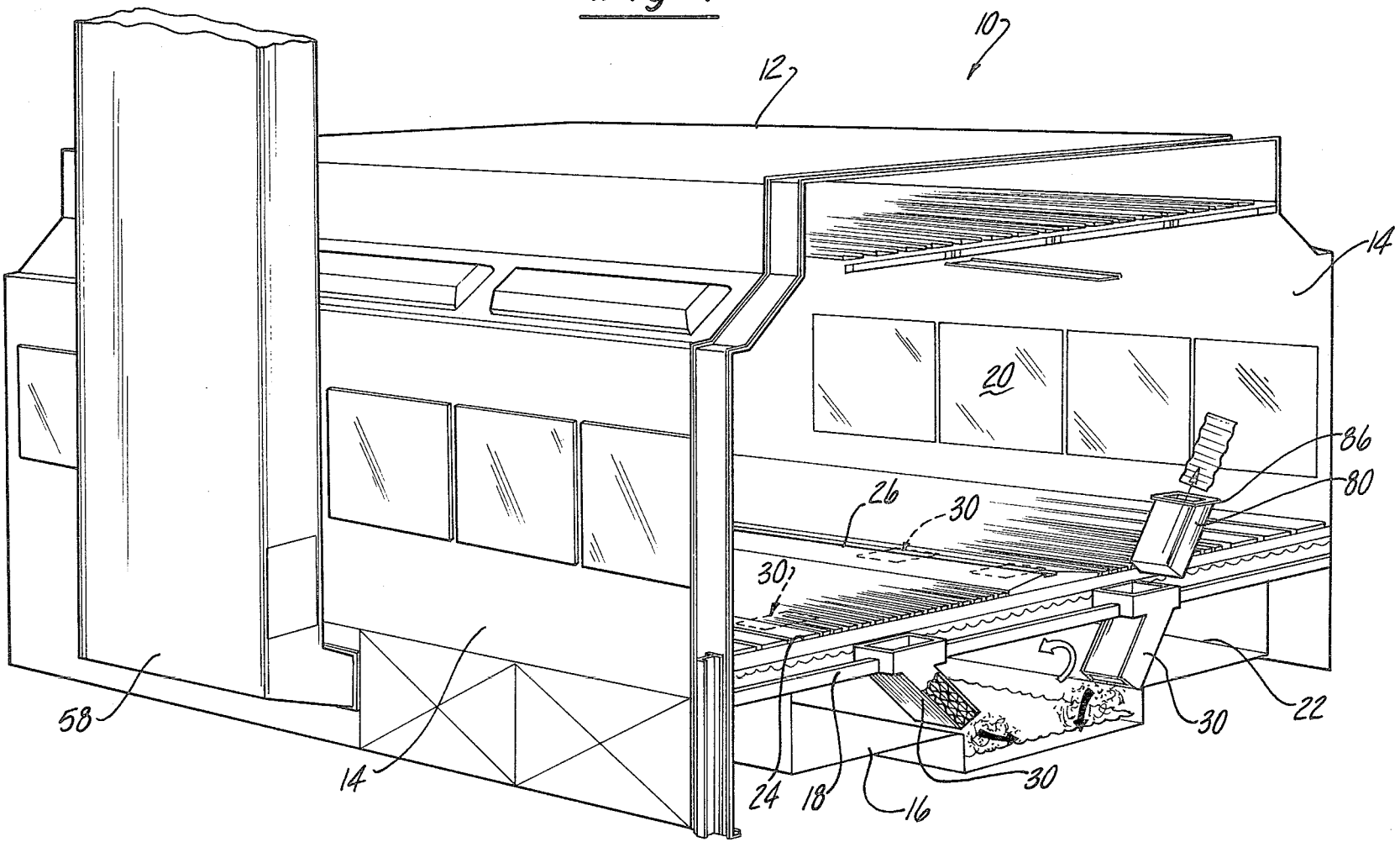
FIG. 1 is a perspective view illustrating a preferred embodiment of the invention.

As best shown in FIG. 1 a plurality of air scrubber units 30 are mounted to the floor 18 at longitudinally spaced intervals along the floor 18. In addition, the air scrubber units 30 are preferably arranged in transversely aligned pairs along the housing floor 18 so that for each pair of transversely aligned air scrubber units 30, one air scrubber unit 30 is open along one side of the vehicle 28 while the other air scrubber unit 30 is open along the other side of the vehicle 28 (FIG. 4).

With reference now particularly to FIGS. 2 and 3 an air scrubber unit 30 is thereshown in greater detail and comprises a duct 32 open at its upper end 34 and lower end 36 and which is generally rectangular in cross sectional shape. The upper end 34 of the duct 30 is secured to a rectangular mounting member 38 having an open top 40 so that the air scrubber unit 30 fluidly connects the upper housing chamber 20 with the lower housing chamber 22. In addition, the side walls 42 of the mounting member 38 protrude upwardly from the floor 18 by a predetermined amount, typically a few inches, for a reason to be subsequently described.

In the preferred form of the invention, a removable guide box 80 (FIGS. 1–3) open at each end 82 and 84 is removably positioned within the duct 32. The guide box 80 is rectangular in cross sectional shape and nests within the duct 32. An outwardly extending lip 86 at the upper end 82 of the guide box 80 limits the insertion of the guide box 80 into the duct 32.

As is best shown in FIGS. 2 and 3, a plurality of longitudinally extending C-shaped channels 44 are secured to opposite sides of the box 80 so that the channels 44 on opposite sides of the box 80 face each other. These channels 44 are adapted to slidably receive baffles constructed from corrugated steel panels 48 which are slidably mounted in the box 80 so that the panels 48 are spaced apart and generally parallel to each other. Appropriate means are provided at the lower end 84 of the box 80 to retain the panels 48 within the box 80.

As is best shown in FIG. 4, the ducts 32 for each pair of transversely aligned air scrubber assemblies 30 are angled toward each other so that the longitudinal axis of each duct 30 intersects the plane of the floor 18 at an angle between 50° and 70°. The lower ends 36 of the ducts 32 are open to a water return trough 52 which is formed in the lower housing chamber 20. The water return trough 52 is fluidly connected to a conventional sludge and water filtration system 54 (illustrated only diagrammatically) which removes solid impurities, i.e., paint particles, from water.

With reference still to FIG. 4, the paint spray booth further comprises at least one water pump 56 (illustrated diagrammatically) which continuously pumps water to the upper surface of the floor 18. The inlet to the water pump 56 can be connected to either a fresh water source or, alternatively, to the output of the water filtration system 54. In addition, at least one and preferably a plurality of air exhaust flues 58 have an inlet end 60 open to the lower housing chamber 22 and an outlet end 62 open exteriorly to the atmosphere. An exhaust fan 64 is mounted adjacent the outlet end 62 of each flue 58 and, upon activation, inducts air in through the flue inlet end 60 and thus from the lower housing chamber 22. This inducted air is exhausted out through its outlet end 62 of the flue 58 and to the atmosphere. Preferably, water elimination baffles 66 are secured within the interior of the exhaust flue 58 to prevent moisture inducted into the inlet end 60 of the flue 78 from contacting and possibly damaging the exhaust fan 64.

In operation, the water pumps 56 and exhaust fans 64 are continuously activated. The continuous supply of water to the upper surface of the floor 18 causes the water to flow over the side walls 42 of the support member 38, which form a weir, and into the open upper end 34 of the duct 32 and guide box 80. Simultaneously, the exhaust fans 64 induct air from the upper housing chamber 20 of the housing, through the air scrubber units 30 and into the lower chamber 22.

Consequently, during activation of both the water pumps 56 and exhaust fans 64, an air-water mixture continuously passes through the air scrubber units 30 as shown by arrows 100 in FIG. 4. In doing so, the baffle panels 48 create turbulences in the air-water flow through the air scrubber units 30 which enhances the intermixture of the air and the water.

During a paint spray operation, the air inducted into the air scrubber units 30 by the exhaust fans 64 is laden with paint particles and the intermixing of water and air caused by the air scrubbing units 30 entraps these paint particles within the water thus purifying the air and, simultaneously, polluting the water. This polluted water is collected within the water return trough 52 and processed by the filtration and sludge system 54 while the now purified air is exhausted by the exhaust fans 64 to the atmosphere.

From the foregoing, it can be seen that the paint spray booth according to the present invention overcomes many disadvantages of the previously known paint spray booths.

First, since the air scrubber units 30 are open at their upper ends to both sides of the vehicle 28 being painted, the excess paint is inducted down along the sides of the vehicle 28 rather than underneath the vehicle 28 as in the previously known spray booths. Consequently, the paint spray booth of the present invention greatly minimizes, or altogether eliminates, clogging and paint accumulation of the vehicle conveyor system 26.

A still further advantage of the paint spray booth according to the present invention is the provision of the removable baffle panels 48 from the ducts 32. Consequently, the operating characteristics and efficiency of the air scrubber units 30 can be modified as required by changing the size, shape or number of the baffle panels 48. For example, if greater intermixing of the air water within the air scrubbing unit 30 is desired, the turbulence within the air scrubber unit 30 can be increased by changing the shape of the surface of the baffle panel 48. Conversely, the open ends 40 of the some of the support members 38 can be simply closed by a cover (not shown) in the event that less air scrubbing efficiency is needed.

A still further advantage of the paint spray booth according to the present invention is that the transversely aligned air scrubber units 30 are angled towards each other. This feature enables the distance between the housing bottom 16 and the floor 18 to be relatively short, e.g., less than 4½ feet, while the effective length of the air scrubber unit 30 is much greater in length due to its acute angle of intersection with the floor 18. Consequently, the spray booth according to the present invention achieves a paint removal efficiency previously obtainable only by paint spray booths having a much greater spacing, typically eight feet or more, between the housing bottom 16 and floor 18.

As is shown in phantom line in FIG. 4, the housing floor 18 is preferably constructed from a plurality of removable panels 70. These removable panels enable access to the housing lower chamber 22 for maintenance, cleaning and the like. Once the maintenance is completed, the panels are replaced to form the floor and appropriate seal means (not shown) are used to seal the panels 70 to each other.

Having described my invention, however, many modifications thereto will become apparent to those skilled in the art to which it pertains without deviation from the spirit of the invention as defined by the scope of the appended claims.

I claim:

1. A paint spray booth for spray painting articles comprising:

a housing having a bottom and a substantially horizontal floor spaced upwardly from the bottom, said floor forming an upper housing chamber and a lower housing chamber, the articles to be painted being positioned in said upper chamber, means for supplying water to an upper surface of said floor, air scrubber means open through said floor and fluidly connecting said housing chambers for intermixing water and air, said air scrubber means comprising an elongated duct open at each end and forming an elongated air/water passageway between said housing chambers, at least one baffle panel, and means for removably securing said at least one baffle within said duct so that said at least one baffle panel lies in a plane substantially parallel to a longitudinal axis of said duct and so that said at least one baffle panel extends along substantially the entire length of said duct, means for inducting an air/water mixture through said air scrubber means and into said lower chamber, means contained within said lower chamber for collecting and removing water inducted into said lower chamber, wherein the vertical spacing between said housing bottom and said housing floor is less than four and one half feet, and wherein said duct extends downwardly from said floor at an acute angle in the range of 50 degrees to 70 degrees.

2. The invention as defined in claim 1 wherein said at least one baffle panel comprises a plurality of corrugated panels secured within said duct so that said corrugated panels are substantially spaced apart and parallel to each other.

3. The invention as defined in claim 1 and comprising means for longitudinally transporting said article through said housing upper chamber, at least two laterally spaced ducts, one of said ducts being open to said floor adjacent one side of said article and the other duct being open to said floor adjacent the other side of the article.

4. The invention as defined in claim 1 wherein said floor comprises a plurality of removable panels for providing access to said lower chamber.

5. The invention as defined in claim 1 wherein said inducting means comprises a flue having an inlet end open to said housing lower chamber, a fan mounted to said flue adjacent an outlet end and means for eliminating moisture between the inlet and outlet ends of said flue.

6. The invention as defined in claim 1 wherein said duct includes a portion protruding upwardly from the floor, said upwardly protruding portion forming a weir.

* * * * *

UNITED STATES PATENT AND TRADEMARK OFFICE

CERTIFICATE OF CORRECTION

PATENT NO. : 4,425,870

DATED : January 17, 1984

INVENTOR(S) : HUGH E. MARSHKE

It is certified that error appears in the above—identified patent and that said Letters Patent is hereby corrected as shown below:

Column 5, line 8 delete "the" second occurrence.

Signed and Sealed this

Tenth Day of July 1984

[SEAL]

*Attest:*

GERALD J. MOSSINGHOFF

*Attesting Officer*

*Commissioner of Patents and Trademarks*